US006974329B2

(12) United States Patent
Henneberg

(10) Patent No.: US 6,974,329 B2
(45) Date of Patent: Dec. 13, 2005

(54) CONNECTION CONTACT FOR ESTABLISHING ELECTRICAL CONTACT IN A CIRCUIT BOARD OR A LEAD FRAME

(76) Inventor: Wolf Neumann Henneberg, Dürbheimerstr.41, D-78604 Rietheim-Wellheim (DE)

( * ) Notice: Subject to any disclaimer, the term of this patent is extended or adjusted under 35 U.S.C. 154(b) by 0 days.

(21) Appl. No.: 10/978,846

(22) Filed: Nov. 1, 2004

(65) Prior Publication Data

US 2005/0101162 A1 May 12, 2005

(30) Foreign Application Priority Data

Nov. 12, 2003 (DE) ..... 103 52 761

(51) Int. Cl.[7] ..... H01R 12/00
(52) U.S. Cl. ..... 439/59; 439/78
(58) Field of Search ..... 439/59, 78, 82, 439/751, 882, 947, 79–80

(56) References Cited

U.S. PATENT DOCUMENTS

| | | | | |
|---|---|---|---|---|
| 3,230,493 A * | 1/1966 | Jensen et al. | 439/79 |
| 4,684,203 A | 8/1987 | Bihler | 439/751 |
| 4,836,806 A | 6/1989 | Dougherty et al. | 439/751 |
| 4,906,209 A * | 3/1990 | Tanabe et al. | 439/620 |
| 5,452,512 A | 9/1995 | Foley et al. | 29/874 |
| 5,556,308 A | 9/1996 | Brown et al. | 439/746 |
| 5,812,797 A * | 9/1998 | Crane et al. | 710/100 |
| 6,060,974 A * | 5/2000 | Schroter et al. | 336/192 |
| 6,186,843 B1 * | 2/2001 | Chen et al. | 439/885 |
| 6,299,492 B1 * | 10/2001 | Pierini et al. | 439/884 |
| 6,835,103 B2 * | 12/2004 | Middlehurst et al. | 439/699.1 |
| 2003/0124886 A1 | 7/2003 | Reisdorf et al. | 439/82 |

FOREIGN PATENT DOCUMENTS

| | | |
|---|---|---|
| DE | 35 33 339 A1 | 3/1987 |
| DE | 101 49 574 A1 | 4/2003 |
| EP | 0 655 798 A2 | 3/1994 |
| GB | 2 127 625 A | 9/1982 |

* cited by examiner

*Primary Examiner*—Michael C. Zarroli
(74) *Attorney, Agent, or Firm*—Renner, Otto, Boisselle & Sklar, LLP

(57) ABSTRACT

The invention concerns a connection contact for establishing electrical contact in a circuit board or in a lead frame. The invention proposes to produce the connection contact, with an insertion section having at least two layers and having at least three spring limbs whose spring action follows a star-shaped pattern, by means of a stamping process. The insertion section proposed by the invention improves the mechanical and electrical connection with a (multi-layer) circuit board or a lead frame. The connection contact is inserted without soldering.

11 Claims, 3 Drawing Sheets

CONNECTION CONTACT FOR ESTABLISHING ELECTRICAL CONTACT IN A CIRCUIT BOARD OR A LEAD FRAME

CROSS-REFERENCE TO RELATED APPLICATION

This application claims priority under 35 U.S.C. §119 to German Patent Application No. 103 52 761, filed Nov. 12, 2003, the entire disclosure of which is incorporated herein by reference.

TECHNICAL FIELD

The invention concerns a connection contact for establishing electrical contact in a circuit board or a lead frame.

BACKGROUND OF THE INVENTION

A connection contact may incorporate a blade contact or a blade receptacle contact (spring contact), for example. It may also be part of an electrical component such as a relay or a switch. In order to establish an electrical or mechanical connection with the circuit board or the lead frame, the connection contact incorporates an insertion section, commonly pin or strip-shaped, that is inserted into an opening of the circuit board or the lead frame. To achieve an electrically conductive connection, one wall of the opening of the circuit board is usually made electrically conductive, either by tinning or through the insertion of a metal sleeve. No soldering or welding takes place.

A connection contact, commonly called insertion pin, is disclosed in EP 0 833 406 A2. In its insertion section, the familiar connection contact has a metal strip that is widened in a central section where the insertion section is curved in the form of a C.

This creates an area with spring action that improves the electrical and mechanical connection when compared with an insertion section consisting of a flat and therefore almost rigid metal strip. The familiar connection contact, when inserted into a cylindrical hole in a circuit board, makes contact at two diametrically opposed places of the hole wall, the contact area taking the shape of a point or—at best—a line.

Another connection contact, called insertion contact, is disclosed in DE 197 26 759 A1. The insertion section of this connection contact, also designed as a metal strip, is slotted longitudinally, forming two limbs of a spring that are bent in a bow shape towards the outside. In a cylindrical hole of a circuit board, the spring limbs also make contact at two diametrically opposed places of the hole wall, the contact area also taking the shape of a point or—at best—a line.

SUMMARY OF THE INVENTION

The invention addresses the problem of improving the electrical and mechanical connection of the insertion section of a connection contact of the type described above.

The insertion section of the connection contact proposed by the invention consists of at least two layers and has at least three spring limbs whose spring action causes them to move towards and away from each other in a star-shaped pattern. Here, star-shaped means that the spring action of the individual limbs follows different directions, i.e. theoretical planes, that form an angle with each other. The spring action of two or more of the spring limbs may be directed in the same plane while at least one additional spring limb acts perpendicular, or at an angle to this plane. Also, the directions of the spring action do not need to have a common center. The spring limbs act perpendicular to an insertion direction of the insertion section of the connection contact into an opening of the circuit board or the lead frame; usually, the insertion direction follows the longitudinal axis of the insertion section. If the insertion section of the connection contact proposed by the invention is inserted into a cylindrical hole in a circuit board or a lead frame, the—at least three—spring limbs contact the wall of the hole in at least three point-shaped, but preferably line-shaped places. Those three places may be distributed evenly or unevenly over the circumference. By giving the outer surface of the spring limbs a cylindrical shape, an area-type instead of a line-shaped contact zone can be achieved. In other words, the contact zones of the spring limbs on the hole wall are not in the same plane. This results in an improvement of the mechanical holding strength of the connection contact in the circuit board. In particular, it counteracts a tilting of the connection contact around a theoretical axis running across the cylindrical hole in a theoretical plane defined by the insertion section. Another advantage is the improvement of the electrical contact due to the improved contact of the spring limbs with the hole wall and the larger number of contact zones. Any electrical contact resistance between the insertion section of the connection contact and a conductor of the circuit board or of the lead frame is reduced. The connection contact can carry a higher amperage, and voltage drop, heating-up of the contact, as well as power loss are reduced. The use of more than three spring limbs, made possible by a connection contact that has two layers in the insertion section, will further improve the mechanical and electrical connection. Thus, the connection contact proposed by the invention meets the increasingly stringent requirements of industry, specifically with regard to the electrical strength of such connection contacts.

In a development of the invention, at least one of the spring limbs has spring characteristics that are different from those of the other spring limbs. For example, a spring limb acting perpendicular to two other spring limbs may have a larger spring force with a given deflection. Different spring characteristics can be achieved by different stamping widths even if all spring limbs are made of the same sheet metal. This design makes it possible to optimize especially the mechanical holding strength of the connection contact in an opening of a circuit board or a lead frame.

One variant of the invention provides for the spring limbs to be separated from each other by slots, but to be of one piece, at least at one end. This way, the insertion section can be made simply and inexpensively by means of a stamping and bending process.

One variant of the invention provides for some of the spring limbs to be distanced further than others from a theoretical longitudinal centerline of the insertion section. This means that the outer surfaces or outer edges of the spring limbs are located on the circumference of theoretical circles of different sizes. Preferably, opposing spring limbs are located on the circumference of one theoretical circle, while spring limbs located between them are on the circumference of a theoretical circle of different diameter. This way, some of the spring limbs are designed for one hole diameter in one circuit board while the other spring limbs are designed for a smaller hole diameter in a different circuit board or in a conductor of a lead frame. This design has the purpose of avoiding damage to a circuit board caused by sharp-edged spring limbs.

In a preferred design variant of the invention, the insertion section of the connection contact tapers towards the insertion end (tip). The insertion end is the end (tip) with which the insertion section first enters the opening in the circuit board or the lead frame. At the insertion end, the insertion section is preferably undersized in relation to the opening of the circuit board or of the lead frame into which the insertion section is to be inserted. This taper enables the insertion section to better "find" the opening in the circuit board or in the lead frame during manual as well as automatic insertion processes. Spring limbs that are of one piece at the insertion end also simplify the insertion of the insertion section into the opening of the circuit board or the lead frame, and, during insertion, prevent a spring limb from catching at the edge of the opening in the circuit board or the lead frame and bending outward.

One design variant of the invention provides for the connection contact to incorporate a stamped sheet metal part that is bent or folded to form at least two stacked layers at least in the insertion section. This design variant of the invention makes it possible to produce a connection contact with a two or multi-layer insertion section from a single piece of sheet metal.

One design variant of the invention provides for at least two sheet metal stampings in contact with each other (packet) to form the connection contact. For higher amperages in particular, the connection contact itself may consist of more than two layers. The insertion sections may also be multi-layered. However, there may also be several two-layer insertion sections at various places of the connection contact that are inserted into an equal number of openings of the circuit board or of the lead frame. Even a single or double layer connection contact may incorporate two or more insertion sections consisting of at least two layers.

One design variant of the invention provides for a connection contact consisting of a packet of stampings. Packet of stampings means that the connection contact is made by stamping several (at least two) congruent pieces of sheet metal that form the layers of the connection contact. Sheet metal stampings are pressed through a die one after the other and then drop on top of each other, forming a packet of stampings. Preferably, the sheet metal stampings are connected with and positioned relative to each other by means of protrusions or similar features, formed by embossing or in some other way, that engage complementary recesses of the adjacent sheet metal stamping. For example, such a recess can be formed on the backside of a protrusion that is being embossed.

The connection contact proposed by the invention is suitable for connecting two circuit boards electrically and/or mechanically. Here, the term "circuit board" means an essentially flat structure with conductors. Beside laminated circuit boards and multilayer boards, the term shall also apply to lead frames. In order to make an electrical connection, conductors of the circuit boards or lead frames are connected so that the connection is electrically conductive. This includes not only the connection of circuit boards or lead frames with each other, but also the connection of circuit boards with lead frames. In order to connect two circuit boards, the insertion section is pushed through congruent holes in the stacked circuit boards that are to be connected. To be electrically conductive, the holes must be in electrical contact with the conductors; tin-plating, for example, will make the hole walls electrically conductive. When lead frames are connected with each other or with circuit boards, the holes are located in the actual conductors of the lead frames which automatically makes them electrically conductive. Another connection option provides for the connection contact to have two or more insertion sections that are inserted into holes in different circuit boards.

The invention is explained in greater detail below with the help of design variants shown in the figure.

DETAILED DESCRIPTION OF THE INVENTION

Figure 1:
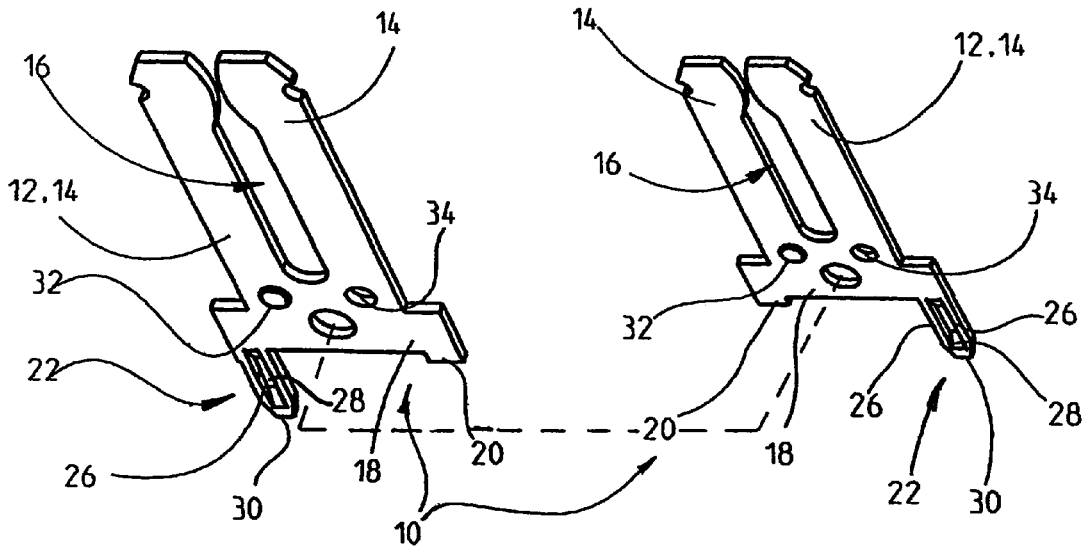
FIG. 1 is an exploded perspective view of a connection contact proposed by the invention.

The connection contact 10 as proposed by the invention and shown in FIG. 1 has two congruent stamped metal parts 12. The connection contact 10 is designed as a blade receptacle contact (spring contact) and has two spring limbs 14 separated from each other by the insertion slot 16. The insertion slot 16 is open at one end and is intended for the insertion of a blade contact (not shown) between the two spring limbs 14. The ends of the spring limbs 14 at the open end of the insertion slot 16 are free.

At the closed end of the insertion slot 16, the spring limbs 14 become one piece in the shape of a crosspiece 18 for seating the connection contact on a (multiplayer) circuit board (not shown) or a conductor of a lead frame (not shown). At one end, a low-profile foot piece 20 with which the connection contact 10 rests on the circuit board or the lead frame conductor protrudes from the crosspiece 18.

At the other end, a strip-shaped insertion section 22 protrudes from the crosspiece 18 of the connection contact 10. When the sheet metal parts 12 of the connection contact 10 are stamped, two slots 24 extending in the longitudinal direction of the strip-shaped insertion section 22 are produced in the insertion section 22; these slots divide the insertion section 22 into three side-by-side spring limbs 26, 28 (see FIG. 3). The slots 24 are closed at both ends, and the three spring limbs 26, 28 become one piece at both ends, with one end becoming part of the crosspiece 18, and the other end forming a tip 30.

As part of the stamping process, the central spring limb 28 is offset at both ends, i.e. it protrudes laterally from the plane defined by the sheet metal stamping 12. The spring action of the two outer spring limbs 26 is effective in the theoretical plane defined by the sheet metal stamping 12 while the spring action of the central spring limb 28 is effective perpendicular to that plane. Since the two outer spring limbs 26 are thinner, their spring tension is lower than that of the central spring limb 28. At its free end pointing away from the crosspiece, the insertion section 22 tapers to form a tip 30. This tip 30 is the end of the insertion section 22 where the insertion starts.

Figure 2:
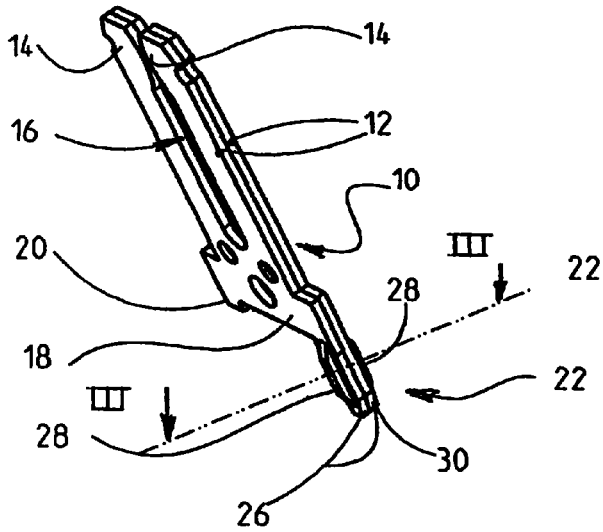
FIG. 2 illustrates the connection contact from FIG. 1 in assembled condition.

The two homologous sheet metal stampings 12 are assembled so that they are congruent and in contact with each other, forming the two-layered connection contact 10 shown in FIG. 2. The insertion section 22 of the connection contact 10 is also two-layered. During the stamping process, the central spring limbs 28 were offset so that both protrude outward. Two protrusions 32 formed during the stamping process in the transition zone from the spring limbs 14 to the crosspiece 18 serve to position the two sheet metal stamping relative to each other, with the two protrusions 32 of one sheet metal stamping engaging the recesses 34 (formed during the stamping of the protrusions 32) of the other sheet metal stamping 12. Since the connection contact is two-layered, the insertion section 22 has a total of 6 spring limbs 26, 28 with an approximately star-shaped spring action.

Figure 3:
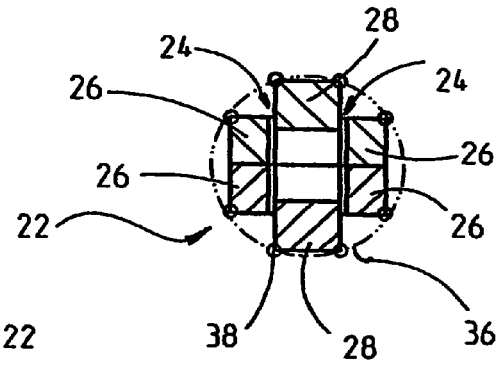
FIG. 3 is a cross-section along line III—III in FIG. 2.

In order to establish a mechanical and electrical connection, the insertion section 22 of the connection contact 10 as shown in FIG. 2 is inserted into an opening of the circuit board (not shown) or lead frame (not shown) until its foot 20 rests on the circuit board or on a conductor of the lead frame. This opening may be a cylindrical hole drilled into the circuit board, or a stamped hole in a conductor of the lead frame. Preferably, the walls of the hole in the circuit board are tin-plated, or a metal sleeve is inserted into the hole. The tip 30 of the insertion section 22 helps in "hitting" the hole. During insertion into the hole, the spring limbs 26, 28 of the insertion section 22 are compressed elastically and hold the connection contact 12 mechanically, without soldering or welding, in the circuit board or the conductor of the lead frame. At the same time, by contacting a wall of the hole into which they are inserted, the spring limbs 26, 28 effect the electrical connection. In FIG. 3, the hole is shown by the dash-dotted circle 36, and the contact zones that appear as points in the cross-section but are actually line-shaped are represented by the small circles 38. The total of six spring limbs 26, 28 of the insertion section 22 are in contact with the wall of the opening in 8 locations distributed over the circumference of the hole. This ensures good mechanical holding strength. The total of eight line-shaped contact zones 38 resulting from the individual or paired spring action of the spring limbs make for a good electrical connection with a low transition resistance. This makes the connection contact 16 suitable for high currents. The current-bearing capacity can be raised by increasing the number of layers, i.e. of sheet metal stampings 12 combined in a packet.

Figure 4:
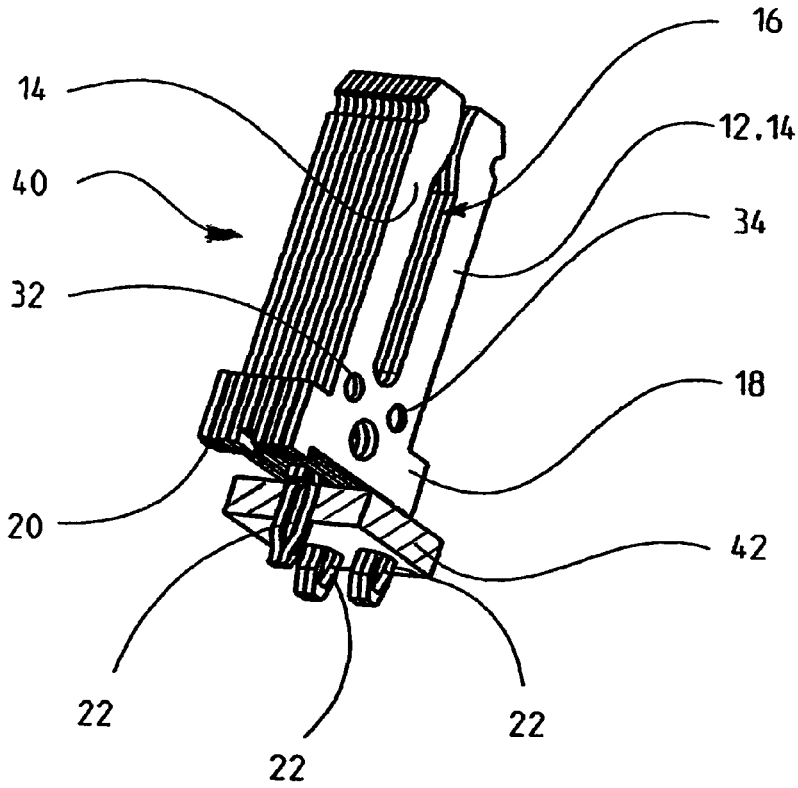
FIG. 4 is a perspective view of a packeted connection contact proposed by the invention.

In order to further increase the electrical strength in particular, more than two sheet metal stampings 12 can be combined in a packet, as shown with the multi-layer connection contact 40 in FIG. 4. Even in this multi-layer connection contact 40 with six, eight, or more layers, the insertion sections 22 consist of two layers, as described in FIG. 1 to 3. The insertion sections 22 of two adjacent sheet metal stampings 12 together form an insertion section 22 with a total of six spring limbs 26, 28. Additional insertion sections 22 are located at a distance on crosspieces 18 of the sheet metal stampings 12. The spacing of the insertion sections 22 can be achieved by forming the insertion section 22 on the next sheet metal stampings 12 at a different location on the crosspiece 18, e.g. the middle or the opposite end of the crosspiece 18 (not shown), and/or again in the same location on the crosspiece 18 but with a spacing produced by at least one, preferably two, or even an integral multiple of two sheet metal stampings 12.

FIG. 4 shows a detail 42 of a conductor of a lead frame (not shown). The conductor 42 has punched cylindrical holes into which the insertion sections 22 have been inserted. Because of the sectional view of the conductor 42, one of the insertion sections 22 appears to be outside the conductor 42; in reality, however, this insertion section 22 is also inserted into a punched hole in the conductor 42.

The sheet metal stampings 12 of the connection contact 40 shown in FIG. 4 are arranged in a packet of stampings, i.e. they were punched through a die one after the other, and dropped on top of each other after the punching. Here, the die positions the sheet metal stampings 12 congruently on top of each other. During the punching process, the protrusions 32 and recesses 34 that fix the sheet metal stampings 12 in position relative to each other are stamped into the parts. The two-layer connection contact 10 shown in FIGS. 1 and 2 may also be made from packet stampings.

Figure 5:
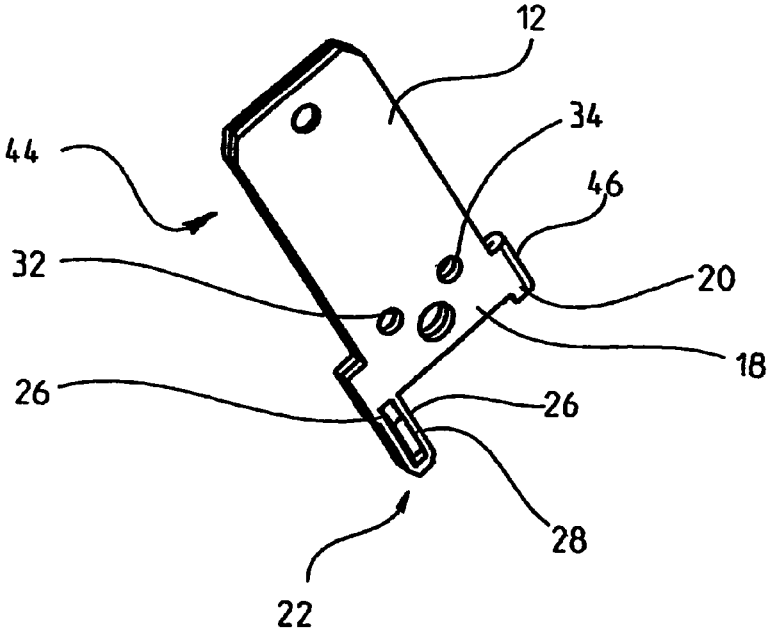
FIG. 5 is a perspective view of another design variant of a connection contact proposed by the invention.

In contrast to the connection contact 10 shown in FIG. 1 to 3, the connection contact 44 shown in FIG. 5 is made from one piece of sheet metal by means of the fold 46 that produces two congruent layers that are folded together. The connection contact 44 is configured as a two-layer blade contact, and its insertion section 22 also consists of two layers with a total of six spring limbs 26, 28. The insertion section of the connection contact 44 in FIG. 5 is identical with the insertion section 22 of the connection contact 10 in FIG. 1 to 3. The only difference is that the two layers of the insertion section 22 of the connection contact 44 are produced by folding a single piece of sheet metal instead of using two separate pieces. In order to avoid repetitions regarding the explanation of FIG. 5, in particular the insertion section 22, we refer to the above explanations of FIG. 1 to 3.

Instead of being designed as plug-in contacts (blade receptacle contacts, blade contacts), the connection contacts proposed by the invention, and in particular their insertion section 22, may also be part of electrical components such as relays or switches (not shown).

Figure 6:
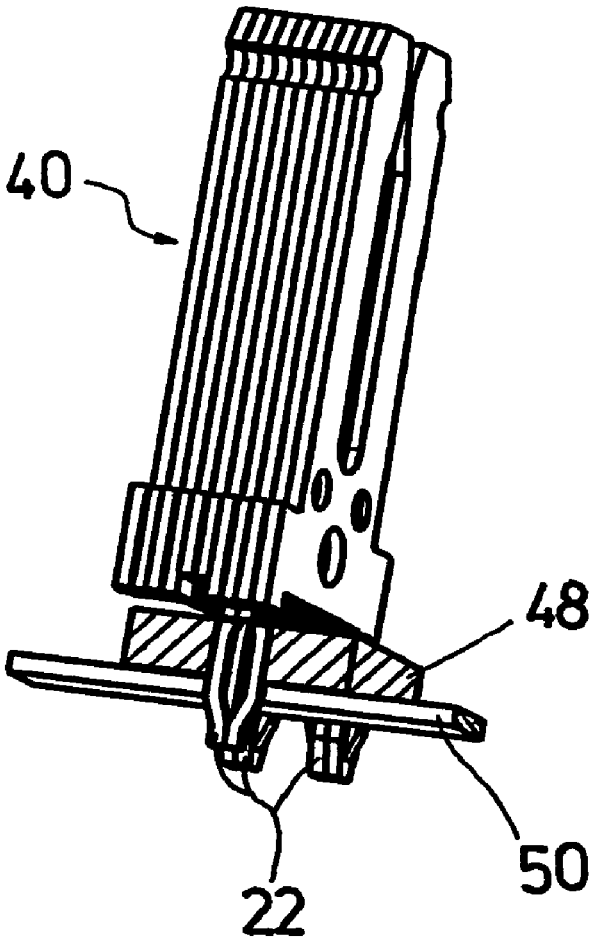
FIG. 6 illustrates a connection of two circuits boards as proposed by the invention with the connection contact shown in FIG. 4.

FIG. 6 shows a connection of two circuit boards 48, 50 as proposed by the invention, using the connection contact 40 shown in FIG. 4. FIG. 6 shows sections of a circuit board or a multilayer board (referred to collectively as circuit board below, for reasons of simplicity) and of a conductor 50 of a lead frame (not shown). The lead frame is considered a circuit board under the terms of the invention. The circuit board 48 is a conventional copper-coated and etched board, i.e. it has conductor tracks that are not visible in the Figure. The circuit board 48 rests on a conductor 50 of the lead frame. The circuit board 48 and the conductor 50 have congruent holes into which an insertion section 22 of the connection contact 40 has been inserted. Because of its clamping effect, the insertion section 22 holds the conductor 50 on the circuit board 48, connecting both mechanically. In order to establish an electrically conductive connection, the hole in the circuit board 48 is located in a not visible conductor track of the circuit board 48, and the hole wall is preferably tin-coated in order to ensure the establishment of an electrical contact. Two (or more) circuit boards 48 or conductors 50 of lead frames can be connected in the same manner.

Figure 7:
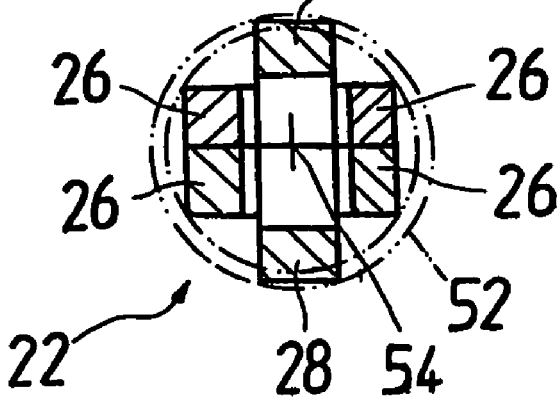
FIG. 7 is a cross-section of an insertion section of the connection contact in FIG. 6.

As can be seen from FIG. 7, the outer edges of the central spring limbs 28 are located on the circumference of a larger theoretical circle 52 than the outer edges of the outer spring limbs 26. Accordingly, the central spring limbs 28 opposing each other have a different (larger) distance from a theoretical longitudinal centerline 54 of the insertion section 22 than the outer spring limbs 26, located in between, that also oppose each other. The reason for that is that the central spring limbs 26 are designed for a larger hole diameter in the circuit board 48, while the outer spring limbs 26 are designed for a smaller hole diameter in the conductor 50.

The circuit board 48 is closer to the connection contact 40 than the conductor 50, and during insertion, the insertion section 22 first enters the circuit board 48. The spring limbs 26, 28 with different outward curvatures or offsets should not damage the circuit board 48 with their sharp edges.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed:

1. A connection contact for establishing electrical contact in a circuit board or a lead frame, where the connection contact has an insertion section that is inserted into an opening of the circuit board or of the lead frame, with the insertion section incorporating spring limbs with a spring action that is perpendicular to the insertion direction, and wherein the connection contact has at least two layers in its insertion section and has at least three spring limbs whose spring actions follow a star-shaped pattern.

2. A connection contact according to claim 1, wherein that the spring limbs are separated by slots but are of one piece, at least at one end.

3. A connection contact according to claim 1, wherein the connection contact has a larger contour in the area of the spring limbs than in the insertion section adjacent to the spring limbs.

4. A connection contact according to claim 1, wherein the insertion section tapers towards its tip.

5. A connection contact according to claim 1, wherein at least two layers of the insertion section are produced by bending or folding.

6. A connection contact according to claim 1, wherein the connection contact incorporates a sheet metal stamping that, at least in the insertion section, is folded or bent to form at least two layers.

7. A connection contact according to claim 1, wherein the connection contact incorporates at least two stacked sheet metal stampings.

8. A connection contact according to claim 1, wherein the connection contact consists of a packet of stampings.

9. A connection contact according to claim 1, wherein the connection contact connects two or more circuit boards.

10. A connection contact for establishing electrical contact in a circuit board or a lead frame, where the connection contact has an insertion section that is inserted into an opening of the circuit board or of the lead frame, with the insertion section incorporating spring limbs with a spring action that is perpendicular to the insertion direction, the connection contact has at least two layers in its insertion section and has at least three spring limbs whose spring actions follow a star-shaped pattern, and wherein at least one spring limb has different spring characteristics than the other spring limbs.

11. A connection contact for establishing electrical contact in a circuit board or a lead frame, where the connection contact has an insertion section that is inserted into an opening of the circuit board or of the lead frame, with the insertion section incorporating spring limbs with a spring action that is perpendicular to the insertion direction, the connection contact has at least two layers in its insertion section and has at least three spring limbs whose spring actions follow a star-shaped pattern, and wherein some of the spring limbs have a greater distance from a theoretical longitudinal centerline of the insertion section than other spring limbs.

* * * * *